US009681211B2

(12) United States Patent
Florian et al.

(10) Patent No.: US 9,681,211 B2
(45) Date of Patent: Jun. 13, 2017

(54) SYSTEM AND METHOD FOR A MICROPHONE AMPLIFIER

(71) Applicant: Infineon Technologies AG, Neubiberg (DE)

(72) Inventors: Wilfried Florian, Villach (AT); Andreas Wiesbauer, Poertschach (AT); Marcus Gehle, Finkenstein (AT)

(73) Assignee: Infineon Technologies AG, Neubiberg (DE)

( * ) Notice: Subject to any disclaimer, the term of this patent is extended or adjusted under 35 U.S.C. 154(b) by 760 days.

(21) Appl. No.: 13/941,273

(22) Filed: Jul. 12, 2013

(65) Prior Publication Data

US 2015/0016636 A1 Jan. 15, 2015

(51) Int. Cl.

*H04R 3/00* (2006.01)
*H04R 1/08* (2006.01)
*H04R 1/04* (2006.01)

(52) U.S. Cl.

CPC ..... *H04R 1/083* (2013.01); *H04R 1/04* (2013.01)

(58) Field of Classification Search

CPC . H04R 1/083; H04R 1/04; H04R 1/06; H04R 1/08; H04R 1/086; H04R 5/04; H04S 1/002; H03G 2201/40; H03F 2200/12; H03F 2200/15; H03F 2200/18; H03F 2200/186; H03F 2200/189; H03F 2200/21; H03F 2200/24; H03F 2200/27; H03F 2200/519; H03F 2200/522; H03F 2200/525; H03F 2200/21127; H03F 2200/21131; H03F 2203/30015; H03F 2203/21127; H03F 2203/21131; H03F 2203/30061; H03F 2203/30063; H03F 2203/30066

USPC ..... 381/26, 28, 57, 323, 71.1, 71.2, 71.3, 381/71.4, 71.5, 71.6, 72, 86, 91, 92, 93, 381/94.5, 94.6, 94.9, 95, 111, 112, 113, 381/114, 115, 120, 122, 314; 330/73, 96, 330/123, 127, 130, 136, 148, 199

See application file for complete search history.

(56) References Cited

U.S. PATENT DOCUMENTS 5,796,850 A * 8/1998 Shiono ..... G10K 11/1782 330/149
2006/0044062 A1* 3/2006 Kojima ..... H03F 1/34 330/253
2009/0316935 A1* 12/2009 Furst ..... H03F 1/3211 381/111

(Continued)

FOREIGN PATENT DOCUMENTS

JP 6331399 A 2/1988
JP 200965433 A 3/2009

(Continued)

OTHER PUBLICATIONS

Sonion, "Application Note—Two-Wire Microphones," Version 002, Jun. 11, 2012, pp. 1-8.

*Primary Examiner* — Leshui Zhang
(74) *Attorney, Agent, or Firm* — Slater Matsil, LLP

(57) ABSTRACT

In accordance with an embodiment, a two-wire microphone includes an integrated circuit. The integrated circuit includes an amplifier having a power supply connection coupled to a first pin of the integrated circuit and a reference connection coupled to a second pin of the integrated circuit, and an impedance element having a first end coupled to an output of the amplifier and a second end coupled to a first node within the integrated circuit.

21 Claims, 3 Drawing Sheets

(56) References Cited

U.S. PATENT DOCUMENTS

| | | | | |
|---|---|---|---|---|
| 2010/0303046 | A1 | 12/2010 | Braithwaite et al. | |
| 2012/0112718 | A1 | 5/2012 | Pons | |
| 2012/0224726 | A1* | 9/2012 | Pahl ..... | H04R 1/04<br>381/174 |
| 2013/0272532 | A1 | 10/2013 | Mazanec | |

FOREIGN PATENT DOCUMENTS

| | | | |
|---|---|---|---|
| JP | 2011193144 | A | 9/2011 |
| KR | 20060050639 | A | 5/2006 |

* cited by examiner

SYSTEM AND METHOD FOR A MICROPHONE AMPLIFIER

TECHNICAL FIELD

The present disclosure relates generally to an electronic device, and more particularly to a system and method for a microphone amplifier.

BACKGROUND

Audio microphones are commonly used in a variety of consumer applications such as cellular telephones, digital audio recorders, personal computers and teleconferencing systems. In particular, lower-cost electret condenser microphones (ECM) are used in mass produced cost sensitive applications. An ECM microphone typically includes a film of electret material that is mounted in a small package having a sound port and electrical output terminals. The electret material is adhered to a diaphragm or makes up the diaphragm itself.

Another type of microphone is a microelectro-mechanical Systems (MEMS) microphone, in which a pressure sensitive diaphragm is etched directly onto an integrated circuit. As such, the microphone is contained on a single integrated circuit rather than being fabricated from individual discrete parts.

Most ECM and MEMS microphones also include a preamplifier that can be interfaced to an audio front-end amplifier via a cord and plug for a target application such as a cell phone or a hearing aid. In many cases, the interface between the preamplifier and front-end amplifier is a three-wire interface coupled to a power terminal, signal terminal and ground terminal. In some systems, however, a two-wire interface is used in which the power and signal terminals are combined into a signal, thereby reducing the cost of the system by using two wires instead of three wires.

Combining a power and signal interface into a single interface, however, poses a number of design challenges with respect to maintaining good audio performance in the presence of power supply noise and disturbances.

SUMMARY OF THE INVENTION

In accordance with an embodiment, a two-wire microphone includes an integrated circuit. The integrated circuit includes an amplifier having a power supply connection coupled to a first pin of the integrated circuit and a reference connection coupled to a second pin of the integrated circuit, and an impedance element having a first end coupled to an output of the amplifier and a second end coupled to a first node within the integrated circuit.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of the preferred embodiments and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, a system and method for a microphone preamplifier that may be used in acoustic systems. Embodiments of the present invention may also be applied to other systems and applications that utilize wired interfaces including, but not limited to sensor systems and data transmission systems.

In an embodiment of the present invention, a two-wire microphone is implemented using an amplifier coupled to an acoustic transducer. The amplifier is integrated with a load impedance on a same integrated circuit such that a supply current of the integrated circuit contains an AC current that is proportional to the acoustic input of the acoustic transducer. By loading the power supply node of the amplifier with an external resistor coupled to a power supply voltage, the AC power supply current can be recovered by a remote amplifier via a two-wire interface.

Figure 1:
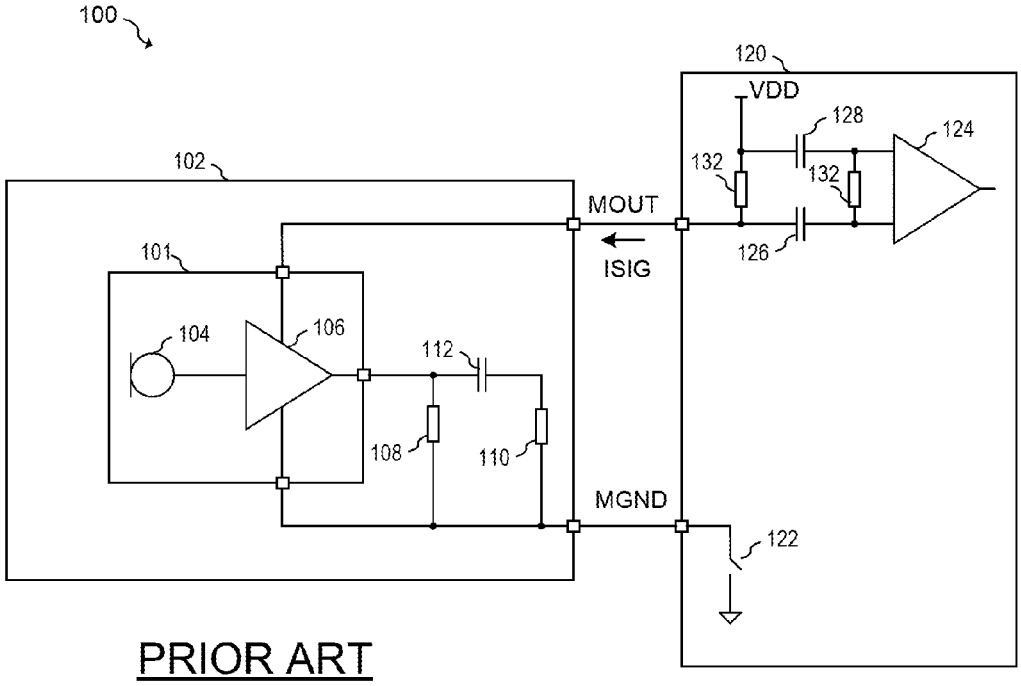
FIG. 1 illustrates a conventional microphone amplification system.

FIG. 1 illustrates a conventional two-wire microphone amplification system 100 that includes microphone unit 102 coupled to main unit 120. Main unit 120 may be contained, for example, on the motherboard of a personal computer, or as a sub circuit on an audio processing chip. Microphone unit 102 includes microphone circuit 101 having acoustic transducer 104 and amplifier 106. Within microphone unit 102, a passive network that includes resistor's 108 and 110 and capacitor 112 are coupled between the output of amplifier 106 and microphone unit ground node MGND. Signals MOUT and MGND form the two-wire microphone interface. Signal MGND is coupled to switch 122, and signal MOUT is coupled to amplifier 124 via AC coupling capacitor 126. Switch 122 may be closed, for example, as a result of a microphone plug containing signals MOUT and MGND being plugged into a receptacle coupled to signals MOUT and MGND using circuits and systems known in the art.

In two wire microphone amplification system 100, amplifier 106 and/or transducer 104 receive their power from and transmits the electrical representation of an acoustic signal via MOUT. Power is provided to amplifier 106 via resistor 132 on main unit 120, while amplifier 124 is configured to amplify the AC signal presence on line MOUT. In system 100, amplifier 106 converts the output of the acoustic transducer to a voltage at node OUT, which drives resistors 108 and 110 and capacitor 112. The signal current ISIG that drives resistors 108 and 110 and capacitor 112 is provided via line MOUT. The operating point for the main unit is determined by the voltage drop across resistor 132 with the given DC load current at the output of the amplifier 106 and the supply current of the microphone. A voltage is developed at an input of amplifier 124 as the result of signal current ISIG being applied to resistor 132. Capacitor 126 couples the signal voltage at line MOUT to a first input of amplifier 124, while capacitor 128 couples the signal voltage at on-chip power supply VDD at a second input of amplifier 124. The AC signal amplitude for amplifier 124 is determined by the relation of parallel connection of resistors 132 in main unit 120 to resistors 108 and 110 at the output of microphone circuit 101.

Figure 2A:
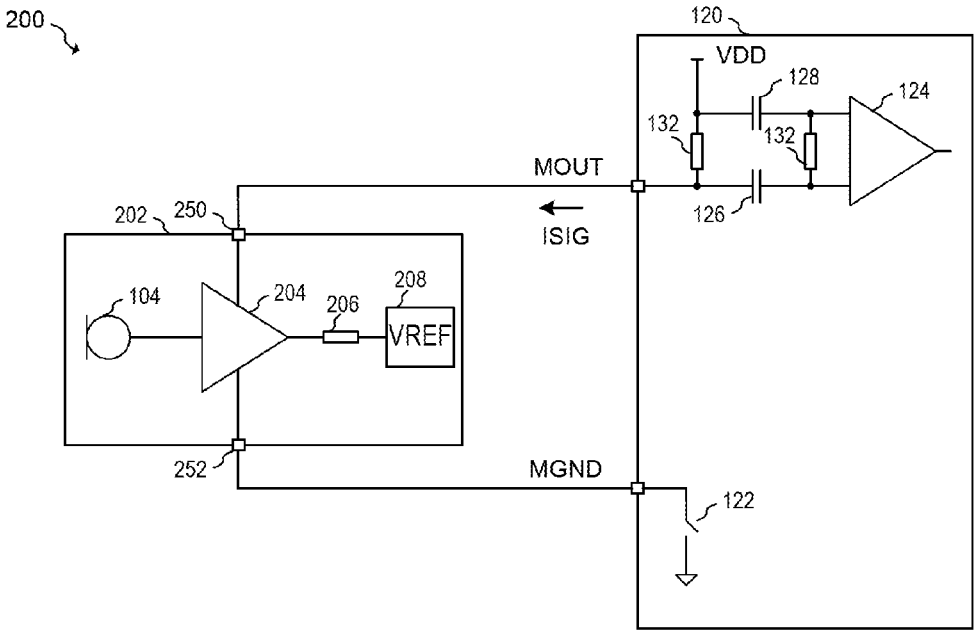
FIGS. 2*a-b* illustrate embodiment microphone amplification systems.

FIG. 2*a* illustrates microphone system 200 according to an embodiment of the present invention. System 200 includes microphone integrated circuit 202 having acoustic transducer 104 coupled to an input of amplifier 204, the output of which is coupled to voltage reference 208 via resistor 206. During operation, the output of acoustic transducer 104 is amplified by amplifier 204. In some embodiments amplifier 204 may be implemented with a source follower transistor having a gain of about one. Alternatively other amplifier architectures may be used that have a unity voltage gains, a voltage gain greater than one, or a voltage gain less than one depending on the particular embodiments and its specifications. The signal current supplied by the output of amplifier 204 is sourced and sunk to voltage reference 208 via resistor 206, which may be in the range of a between 500 Ω about 10 kΩ. Alternatively, other ranges may be used. In some embodiments, an arbitrary impedance network may be used in place of resistor 206 that includes one or more resistors, capacitors and/or inductances. In some embodiments, resistor 206 may include a plurality of series and/or parallel connected resistors.

In alternative embodiments, main unit 120 may have an amplifier with a low input impedance, such as a current amplifier or a transimpedance amplifier that converts the current output of integrated circuit 202 to a signal current. Such a current amplifier or transimpedance amplifier may also be applied to three-wire microphone circuits.

The resulting signal current is sourced to amplifier 204 via signal line MOUT that is coupled to main unit 120 as described above. In some embodiments, the AC portion of signal current ISIG may be between about 1 μA and about 300 μA, while the DC current may be between about 1 μA and about 100 μA. Alternatively, other current ranges may be used. Amplifier 204 may be implemented using circuit techniques known in the art. The voltage reference block 208 defines a regulated reference node with a characteristic that provides either a current driving or a current sinking capability depending on the reference voltage chosen. In some embodiments, by providing either a current driving or current sinking capability, the situation in which current delivered from reference block 208 is in opposite phase of the signal and cancel out current ISIG may be avoided. This may be implemented, for example, by configuring reference block 208 to output a voltage that is greater than or less than the average DC voltage at the output of amplifier 204. In some embodiments, this voltage is greater or less then the DC voltage at the output of amplifier 204 by a margin that prevents the output current of amplifier 204 from reversing its polarity. This margin is a function of the resistance of resistor 206 and the expected DC signal current. In other embodiments, the reference voltage of block 208 may be about equal to the DC voltage at the output amplifier 204. Voltage reference 208 may be implemented using circuit systems and methods known in the art. For example, voltage reference 208 may be implemented using a bandgap voltage reference. In some embodiments, the reference voltage 208 may be derived by a same bandgap generator used to provide reference voltages for amplifier 204 and other circuitry on integrated circuit 202.

In an embodiment, integrated circuit 202 is interfaced to main unit 120 using only pins 250 and 252 that are coupled to signal lines MOUT and MGND, respectively. Acoustic transducer 104 may be implemented, for example, using an on-chip MEMS microphone. Power is provided to integrated circuit 202 via VDD on main unit 120 that may be in the range, for example, of about 1 V to about 5 V. Alternatively, other ranges may be used.

Figure 2B:
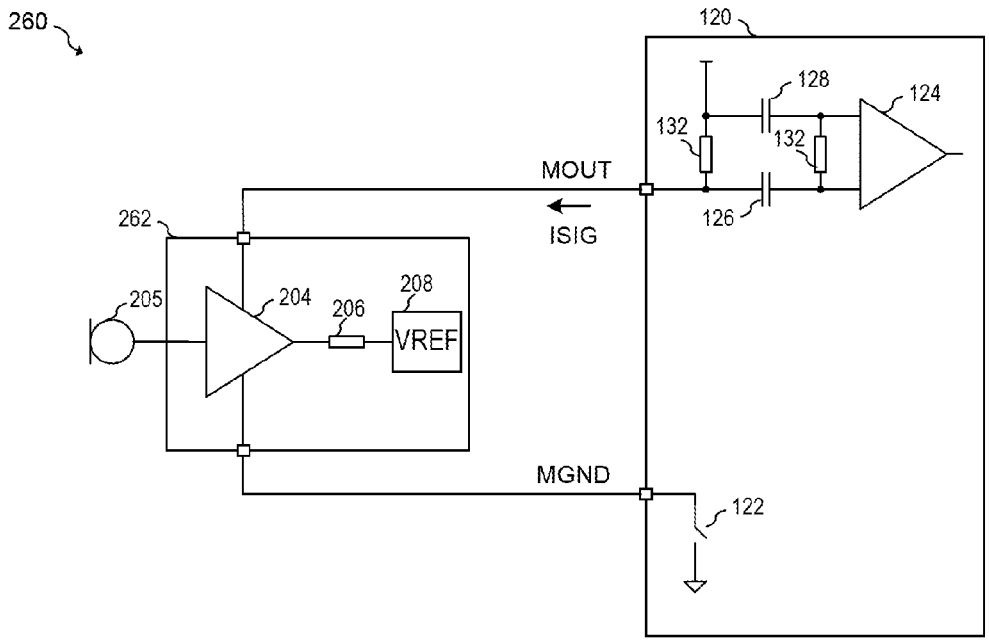

FIG. 2*b* illustrates system 260 according to a further embodiment of the present invention that includes amplifier integrated circuit 262 coupled to external acoustic transducer 205 that may be implemented, for example, by a MEMS device or an ECM device. The embodiment of FIG. 2*b* is similar to the embodiment of FIG. 2*a* in that the output of amplifier 204 is coupled to reference generator 208 via resistor 206.

Figure 3:
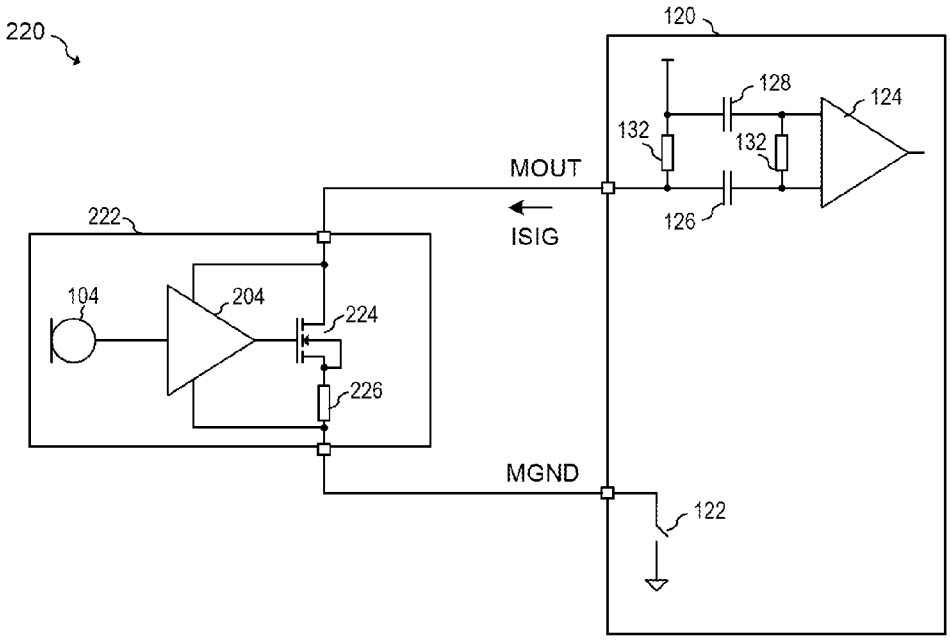
FIG. 3 illustrates a further embodiment microphone amplification system.

FIG. 3 illustrates microphone amplification system 220 according to a further embodiment of the present invention. System 220 has integrated circuit 222 coupled to main unit 120. Integrated circuit 222 includes acoustic transducer 104 that is amplified by amplifier 204. The output of amplifier 204 is coupled to the gate of NMOS 224 and forms with resistor 226 and resistor 132 a NMOS common-source amplifier. In alternative embodiments of the present invention, a BJT or other device may be used instead of NMOS device 224. During operation of microphone amplification system 220, signal current ISIG is generated by NMOS common-source device 224. The AC signal amplitude for amplifier 124 is determined by the relation of parallel connection of resistors 132 in the main unit to the resistors 226. In further embodiments, additional control/regulation loops for NMOS 224 could be implemented to increase linearity and PSRR.

Figure 4:
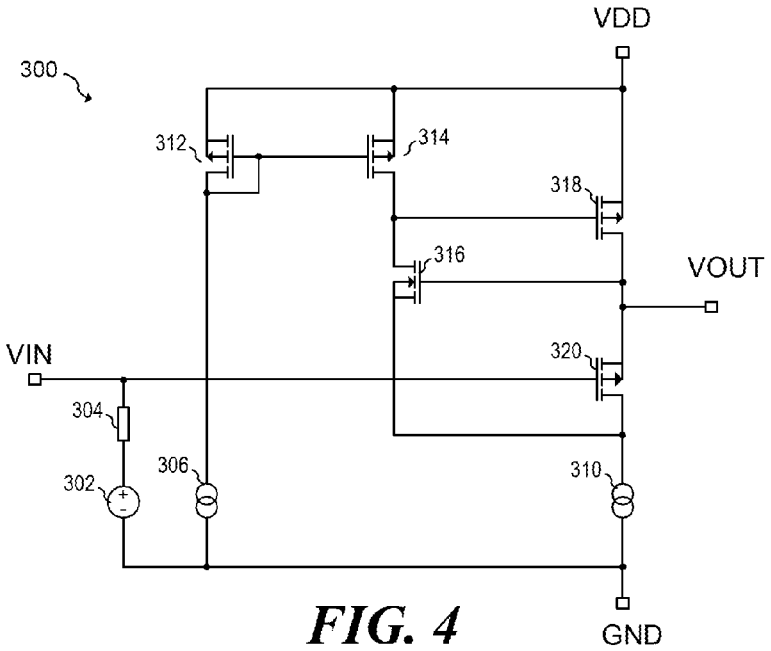
FIG. 4 illustrates an embodiment amplifier.

FIG. 4 illustrates a schematic of amplifier 300, which may be used to implement amplifier 204 in various embodiments. Amplifier 300 has PMOS source follower transistor 320 coupled to input voltage VIN at its gate. The output of PMOS source follower transistor 320 is coupled to output node VOUT. Current sources 306 and 310 provide constant bias currents. Without a signal at the input, a constant current flows through PMOS 318 and 320 given by the bias current of NMOS 310. With a resistive load at node VOUT an additional constant current flows through PMOS 318. During operation when the input signal on PMOS 320 increases, the voltage at node VOUT increases and NMOS 316 pulls down the gate voltage of output PMOS transistor 318 which delivers current to the output load. On the other hand, when input signal on PMOS 320 decreases, the gate voltage on PMOS 318 increases and current source 310 can sink current from node VOUT. Since the gate voltage of PMOS 318 is controlled with the output signal, a linear current provided to the load at VOUT is also drawn from VDD. Also, with NMOS 316, the gate-drain capacitance Cgd of source follower PMOS 320 is boosted and reduces the input capacitance of the source follower. Current is provided to the drain of NMOS 316 via current source 306 and a current mirror made of PMOS devices 314 and 314. Current sources 306 and 310 may be implemented using biasing circuits and techniques known in the art. Input node VIN is biased using voltage source 302 and a high ohmic resistance 304 that may be implemented with NMOS or PMOS transistors, a large resistor, or other semiconductor structure. Voltage source 302 may be implemented using voltage reference circuits and techniques known in the art.

In an embodiment, amplifier 300 has a voltage gain of about 1. In alternative embodiments, other transistor device types, such as BJTs may be used. In one embodiment, NMOS transistors may be exchanged with PMOS transistors and PMOS transistors may be exchanged with NMOS transistors.

Figure 5:
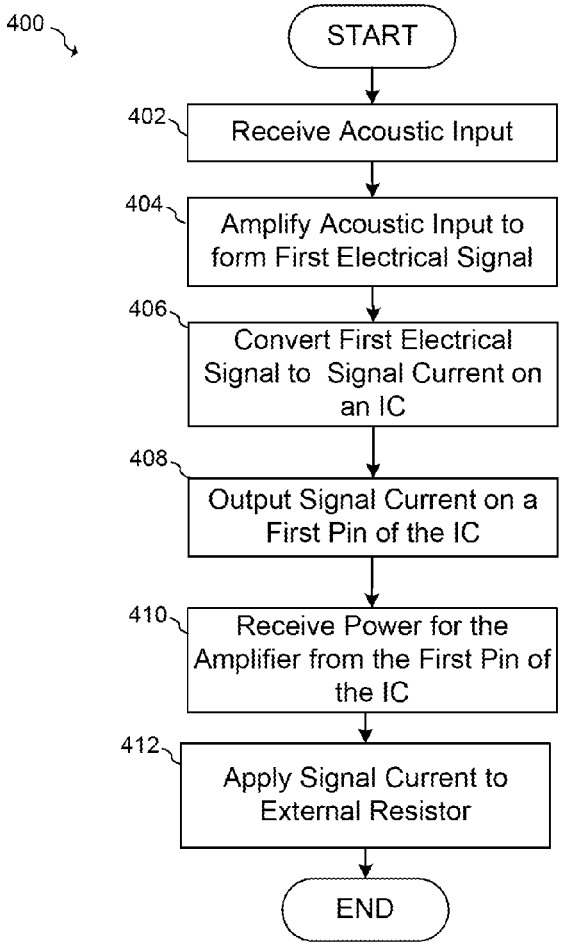
FIG. 5 illustrates a block diagram of an embodiment method.

FIG. 5 illustrates a block diagram of embodiment method 400 of operating a two-wire microphone that includes receiving an acoustic input using an acoustic transducer in step 402. The acoustic transducer may be constructed on an integrated circuit using, for example, a MEMS microphone, and/or may be implemented using other acoustic transducer devices, such as an electret microphone. In step 404, the output of the acoustic transducer is amplified to produce a first electrical signal. In some embodiments, this amplification is performed by an amplifier disposed on an integrated circuit. In step 406, the first electrical signal is converted into a signal current on an integrated circuit. In some embodiments, the signal current is produced by loading the output of an amplifier with a resistor in series with a reference voltage source. Alternatively, the signal current may be generated using a NMOS transistor with its source resistor forming with the external application a common-source amplifier. Once the first electrical signal has been converted to a signal current, the signal current is output on a first pin of the integrated circuit in step 408. In some embodiments, the output signal current has a signal path that runs from the output of an amplifier to a power supply rail of the amplifier. In step 410, an amplifier on the integrated circuit receives power from the same first pin that outputs the signal current. In some embodiments, the signal current is received by applying the signal current to an external resistor coupled to a power supply in step 412. This external resistor may be disposed external to the two-wire microphone.

In accordance with an embodiment, a two-wire microphone includes an integrated circuit. The integrated circuit includes an amplifier having a power supply connection coupled to a first pin of the integrated circuit and a reference connection coupled to a second pin of the integrated circuit, and an impedance element having a first end coupled to an output of the amplifier and a second end coupled to a first node within the integrated circuit. The two-wire microphone may further include an acoustic transducer having an output coupled to an input of the amplifier. This acoustic transducer may be disposed on the integrated circuit.

The two-wire microphone may further include a reference voltage generator disposed on the integrated circuit, such that the reference voltage generator has an output coupled to the first node.

In some embodiments, the two-wire microphone includes a transistor having a control node coupled to the output of the amplifier and a first output node coupled to the first pin. In one case, the first end of the impedance element is coupled to a second output node of the transistor, the first end of the impedance element is coupled to the output of the amplifier via the transistor, and the first node is coupled to the second pin. In an embodiment, the transistor is implemented using a MOSFET such that the control node of the transistor is a gate of the MOSFET, the first output node of the transistor is a drain of the MOSFET, and the second output node of the transistor is a source of the MOSFET.

In accordance with a further embodiment, a semiconductor circuit includes a semiconductor substrate, an acoustic transducer disposed on the semiconductor substrate, and an amplifier disposed on the semiconductor substrate, an impedance element disposed on the semiconductor substrate, a first pin coupled to the amplifier, and a second pin configured to be coupled to a reference node. The amplifier has an input coupled to an output of the acoustic transducer, the impedance element has a first end coupled to an output of the amplifier, and the first pin is configured to receive power for the semiconductor circuit and to output a signal current proportional to an acoustic output node. In some embodiments, the reference node is a ground node. The semiconductor circuit may be a two-wire microphone circuit configured to interface to an audio processor via only the first pin and the second pin.

In an embodiment, the semiconductor circuit further includes a reference voltage generator disposed on the semiconductor substrate, such that the reference voltage generator has an output coupled to a second end of the impedance element, such as a resistor. The semiconductor circuit may also include a transistor having a control node coupled to the output of the amplifier and a first output node coupled to the first pin. In one example, the first end of the impedance element is coupled to the output of the amplifier via the transistor, the first end of the impedance element is coupled to a second output node of the transistor, and a second end of the impedance element is coupled to the second pin. In an embodiment, the transistor is implemented using a MOSFET, the control node of the transistor is a gate of the MOSFET, the first output node of the transistor is a drain of the MOSFET, and the second output node of the transistor is a source of the MOSFET.

In accordance with a further embodiment, a method of operating a two-wire microphone includes receiving an acoustic input using an acoustic transducer, amplifying the acoustic input to produce a first electrical signal, wherein amplifying comprises using an amplifier disposed on a first integrated circuit. The method further includes converting the first electrical signal into a signal current, wherein converting includes using the amplifier to apply a voltage across an impedance element that is disposed on the first integrated circuit. Moreover, the method also includes outputting the signal current on a first pin of the integrated circuit, and receiving power for the amplifier from the first pin of the integrated circuit.

In an embodiment, converting the first electrical signal into a signal current includes applying the first electrical signal to a first terminal of the impedance element using the amplifier, and applying a DC voltage to a second terminal of the impedance element. Applying the DC voltage may include using a reference voltage generator disposed on the integrated circuit. Moreover, converting the first electrical signal into a signal current includes applying the first electrical signal to a first terminal of the impedance element using a source follower transistor having a gate coupled to an output of the amplifier, and coupling a second terminal of the impedance element to a second pin of the integrated circuit.

In an embodiment, receiving the acoustic input using the acoustic transducer includes using an acoustic transducer disposed on the integrated circuit. The method may also include coupling the first pin of the integrated circuit and a second pin of the integrated circuit to an audio receiving circuit.

Advantages of some embodiments in which amplifier loading elements are included on-chip include lower cost, smaller board area, and/or an increased PSRR. In some cases, the lower cost may be a result of having few or none external components and a reduced number of interface pads.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

What is claimed is:

1. A two-wire microphone circuit comprising:

an integrated circuit comprising:

a semiconductor substrate;

an amplifier disposed on the semiconductor substrate, the amplifier having a power supply connection coupled to a first pin of the integrated circuit and a reference connection coupled to a second pin of the integrated circuit, wherein an input of the amplifier is configured to receive an audio signal;

an impedance element disposed on the semiconductor substrate, the impedance element having a first end coupled to an output of the amplifier; and a reference voltage generator disposed on the semiconductor substrate, wherein the reference voltage generator has an output coupled to a second end of the impedance element, wherein the reference voltage generator is configured to provide current sourcing or current sinking at the output of the reference voltage generator.

2. The two-wire microphone circuit of claim 1, further comprising an acoustic transducer having an output coupled to the input of the amplifier.

3. The two-wire microphone circuit of claim 2, wherein the acoustic transducer is disposed on the integrated circuit.

4. The two-wire microphone circuit of claim 1, wherein the reference voltage generator is configured to output a reference voltage that is greater than or less than a DC output voltage of the amplifier.

5. The two-wire microphone circuit of claim 1, wherein the reference voltage generator provides a regulated voltage.

6. The two-wire microphone circuit of claim 5, wherein the reference voltage generator is a bandgap voltage generator.

7. The two-wire microphone circuit of claim 1, wherein the reference voltage generator outputs a first regulated voltage that is greater than or less than an average DC voltage at the output of the amplifier.

8. The two-wire microphone circuit of claim 1, wherein the amplifier comprises only a single audio input.

9. The two-wire microphone circuit of claim 7, wherein the first regulated voltage is greater or less than the average DC voltage at the output of the amplifier by a margin that prevents the output of the amplifier from reversing a polarity of the output of the amplifier.

10. A semiconductor circuit comprising:

a semiconductor substrate;

an acoustic transducer disposed on the semiconductor substrate;

an amplifier disposed on the semiconductor substrate, wherein the amplifier has an input coupled to an output of the acoustic transducer;

a transistor disposed on the semiconductor substrate, wherein the transistor has a control node coupled to the output of the amplifier;

an impedance element disposed on the semiconductor substrate, wherein the impedance element has a first end coupled to a first output node of the transistor;

a first pin coupled to a second output node of the transistor, wherein the first pin is configured to receive power for the semiconductor circuit and to output a signal current proportional to an acoustic output; and a second pin configured to be coupled to a reference node.

11. The semiconductor circuit of claim 10, wherein the reference node is a ground node.

12. The semiconductor circuit of claim 10, wherein the impedance element comprises a resistor.

13. The semiconductor circuit of claim 10, wherein the semiconductor circuit is a two-wire microphone circuit configured to interface to an audio processor via only the first pin and the second pin.

14. The semiconductor circuit of claim 10, wherein a second end of the impedance element is coupled to the second pin.

15. The semiconductor circuit of claim 14, wherein:

the transistor comprises a MOSFET;

the control node of the transistor is a gate of the MOSFET;

the first output node of the transistor is a drain of the MOSFET; and the second output node of the transistor is a source of the MOSFET.

16. The semiconductor circuit of claim 10, wherein the transistor is in a common-source configuration.

17. A method of operating a two-wire microphone comprising:

receiving an acoustic input using an acoustic transducer of the two-wire microphone;

amplifying the acoustic input to produce a first electrical signal, wherein amplifying comprises using an amplifier disposed on an integrated circuit, wherein the integrated circuit comprises a semiconductor substrate;

converting the first electrical signal into a signal current, wherein converting comprises using the amplifier to apply a voltage across an impedance element coupled to an active device, wherein the active device and the impedance element are disposed on the semiconductor substrate;

outputting the signal current on a first pin of the integrated circuit; and receiving power for the amplifier from the first pin of the integrated circuit.

18. The method of claim 17, wherein the active device comprises a reference voltage generator, and wherein converting the first electrical signal into a signal current comprises:

applying the first electrical signal to a first terminal of the impedance element using the amplifier; and applying a DC voltage to a second terminal of the impedance element, wherein applying the DC voltage comprises using the reference voltage generator disposed on the integrated circuit.

19. The method of claim 17, wherein the active device comprises a source follower transistor, and wherein converting the first electrical signal into a signal current comprises:

applying the first electrical signal to a first terminal of the impedance element using the source follower transistor, the source follower transistor having a gate coupled to an output of the amplifier; and coupling a second terminal of the impedance element to a second pin of the integrated circuit.

20. The method of claim 17, wherein the acoustic transducer is disposed on the integrated circuit.

21. The method of claim 17, further comprising coupling the first pin of the integrated circuit and a second pin of the integrated circuit to an audio receiving circuit.

* * * * *